US012668391B2

(12) United States Patent
Pierantoni et al.

(10) Patent No.: US 12,668,391 B2
(45) Date of Patent: Jun. 30, 2026

(54) LAUNCHER OF PAPER PRODUCTS

(71) Applicant: Valmet Tissue Converting S.p.A., Lucca (IT)

(72) Inventors: Marco Pierantoni, Valsamoggia (IT); Daniele Bolognesi, Ozzano Dell'Emilia (IT)

(73) Assignee: Valmet Tissue Converting S.p.A., Lucca (IT)

( * ) Notice: Subject to any disclaimer, the term of this patent is extended or adjusted under 35 U.S.C. 154(b) by 70 days.

(21) Appl. No.: 18/870,965

(22) PCT Filed: Jun. 1, 2023

(86) PCT No.: PCT/IB2023/055654
§ 371 (c)(1),
(2) Date: Dec. 2, 2024

(87) PCT Pub. No.: WO2023/233358
PCT Pub. Date: Dec. 7, 2023

(65) Prior Publication Data

US 2025/0340318 A1 Nov. 6, 2025

(30) Foreign Application Priority Data

Jun. 3, 2022 (IT) ..... 102022000011771

(51) Int. Cl.
*B65B 35/24* (2006.01)
*B65B 25/14* (2006.01)
*B65B 65/02* (2006.01)

(52) U.S. Cl.
CPC ..... *B65B 35/243* (2013.01); *B65B 25/145* (2013.01); *B65B 25/146* (2013.01); *B65B 65/02* (2013.01)

(58) Field of Classification Search
CPC ... B65B 35/243; B65B 25/145; B65B 25/146; B65B 65/02; B65B 59/005; B65G 47/31
See application file for complete search history.

(56) References Cited

U.S. PATENT DOCUMENTS 3,794,154 A * 2/1974 Holt ..... B65G 47/31 53/543
3,823,813 A * 7/1974 Holt ..... B65G 47/31 198/620

(Continued)

FOREIGN PATENT DOCUMENTS

EP 1937557 B1 1/2010
EP 2763917 B1 12/2015

(Continued)

*Primary Examiner* — Andrew M Tecco
(74) *Attorney, Agent, or Firm* — Breiner & Breiner, L.L.C.

(57) ABSTRACT

A launcher of paper products for packaging stations of paper product converting lines, including a frame with at least two launch channels, on which products are arranged, and each launch channel has opposite movable surfaces, at least one being motorized, arranged in contact with opposite sides of the respective product in the channel, to draw the product in the launch direction. The two movable surfaces are below and above the space occupied by the product in the respective channel to drag the product by acting on lower and upper sides thereof. At least a kinematic connection apparatus is provided for kinematically connecting the motorized movable surfaces of the launch channels. The movable surfaces launch simultaneously the products in the launch direction, at least one disconnection/connection device being provided for kinematically disconnecting/connecting at least one movable surface from/to the at least one kinematic connection apparatus, that can be operated on command.

20 Claims, 6 Drawing Sheets

(56) References Cited

U.S. PATENT DOCUMENTS

| | | | | |
|---|---|---|---|---|
| 3,938,650 | A * | 2/1976 | Holt | B65B 35/243 198/433 |
| 4,360,098 | A * | 11/1982 | Nordstrom | B65G 47/31 198/572 |
| 7,784,606 | B2 * | 8/2010 | Bonora | H10P 72/34 198/817 |
| 8,881,888 | B2 * | 11/2014 | Overley | B65B 59/005 198/817 |
| 11,225,384 | B2 * | 1/2022 | Karst | B65B 65/02 |
| 11,459,189 | B2 * | 10/2022 | Behr | B65B 7/162 |
| 2010/0051422 | A1 * | 3/2010 | Bonora | H10P 72/34 198/817 |
| 2012/0318954 | A1 * | 12/2012 | Overley | B65B 25/146 248/639 |
| 2021/0107749 | A1 * | 4/2021 | Behr | B65B 7/164 |

FOREIGN PATENT DOCUMENTS

| | | | |
|---|---|---|---|
| EP | 3625131 | B1 | 4/2021 |
| GB | 1527574 | | 10/1978 |
| WO | 2014033637 | A1 | 3/2014 |
| WO | 2021053571 | A1 | 3/2021 |

* cited by examiner

LAUNCHER OF PAPER PRODUCTS

TECHNICAL FIELD

The present invention relates to the field of paper product packing plants; more in particular, the invention concerns a launcher of paper products for packaging stations of paper products, such as, for example, rolls of so-called tissue paper. The invention further concerns a paper product converting line where the step of packing the final product is optimized.

STATE OF THE ART

Paper products, for example tissue paper products, in particular rolls of toilet paper, kitchen towels, interfolded products, handkerchiefs, napkins, paper towels, wipes, cleaning absorbing paper etcetera, are produced in producing lines referred to as converting lines.

For example, tissue paper rolls are produced from tissue paper rolls of large diameter, the so-called master rolls or parent reels. One or more parent reels are unwound to supply, with one or more plies of tissue paper, a rewinder, which forms secondary reels of axial length equal to the axial length of the parent reels, and diameter equal to the diameter of the finished product destined for consumption. The tissue paper plies coming from the parent reels are bonded together to form a web material, which is wound in secondary reels in a winding cradle of a rewinder.

The winding cradle is typically comprised of a plurality of motorized winding rollers, combined, if necessary, with winding mandrels or tail stocks, for example in some cases when the rolls are formed around tubular winding cores. The winding rollers are kept in rotation at adequate peripheral speeds, and in surface contact with the secondary reel being formed, so as to transmit this secondary reel the torque necessary for winding it.

Then, the secondary reels are subjected to a series of further processing, among which: closing the tail edge of the web material, to prevent it from interfering with the successive steps of the production process, and cutting into single rolls of axial dimension equal to the axial dimension of the finished product intended for consumption. During the cutting step, the ends of the secondary reel, where usually a series of defects in the continuity and thickness of the wound product are concentrated, are trimmed, i.e. cut away. The wastes resulting from cutting the ends are called "trims"; once they have been cut, they are collected and sent to the pulping mill.

The rolls produced in this manner are fed to a packaging station, for example keeping the axis thereof horizontal.

Mainly, the packaging stations have entrance devices, like transport belts, to which launchers are associated, launching the products onto an intermediate module where the products are grouped together and pushed towards a forming station, where a group of rolls is formed, and a vertically movable elevator, thus realizing a group of adjacent rolls, with horizontal axis, in one or more layers Then, the packing machine wraps the group of rolls with a plastic or paper sheet, thus forming the pack of rolls. An example of such packaging station is disclosed in WO2014033637.

Launchers generally comprise a frame where at least two launch channels are provided, typically four or five, on which the products to be launched are arranged, and wherein each launch channel has a sliding bottom, on which the products rest, and opposite motorized lateral belts arranged in contact with opposite lateral portions of the respective product housed in the channel, to drag the product in the launch direction.

These packaging stations, even if appreciated by the market thanks to the reliable operation, can be however improved.

In fact, the market of the machines for producing and packing tissue paper products requires lines suitable to continuously increase the production speed and, thus, the packing speed.

The market further requires increasingly performing machines in terms of production flexibility, and therefore in terms of packing flexibility of different products on the same line, thus reducing as much as possible the downtimes necessary to set-up the lines for changing product.

Furthermore, the market often requires more eco-friendly packing systems, i.e. more sustainable from an environmental point of view than the known systems.

Therefore, the known launchers described above are not suitable for the packaging needs in terms of flexibility, with products different in both type and size.

SUMMARY

The object of the invention is to provide a launcher of paper products for packaging stations of paper product converting lines, as well as a packing machine for packing tissue paper products, and a converting line carrying a packing machine, adapted to meet the needs in the production of paper products such as toilet paper rolls, kitchen towels rolls, napkins, handkerchiefs, interfolded products, etcetera.

More particularly, an important object of the present invention is to provide a launcher capable of speeding up the format change step of the products to be launched.

A further important object of the present invention is to provide a launcher of paper products which is flexible in use, i.e. which allows to work with products of different types, even simultaneously, and to package the products according to different methods.

Another object of the present invention is to provide a launcher of simplified structure, that is therefore more economical, flexible, highly simple to use and that keeps or improves the productivity performance of the launchers known in the art.

These and other objects, which will become clearer hereinafter, are achieved with a launcher of paper products for packaging stations of paper product converting lines, comprising a frame where at least two launch channels are provided, on which the products to be launched are arranged, and wherein each launch channel has opposite movable surfaces, at least one of which being motorized, arranged in contact with opposite sides of the respective product housed in the channel, to drag the product in the launch direction, characterized in that the two opposite movable surfaces are arranged below and above the space that can be occupied by the product in the respective channel, so as to draw the product by acting on the lower and upper sides thereof, and wherein at least a kinematic connection apparatus is provided for kinematically connecting the motorized movable surfaces of the launch channels, at least one device being provided for kinematically disconnecting/connecting at least one movable surface from/to the at least one kinematic connection apparatus, that can be operated on command.

In practice, one (or more) launch channel(s), when connected by means of the at least one disconnection/connection device, can operate together with the other channels as actuated by the kinematic connection apparatus, or can be inactive when the other channels are actuated together by the kinematic connection apparatus, as disconnected by the at least one kinematic disconnection/connection device, or can be even activated after a certain time interval while the other channels are still active.

By connection, each launch channel can be, together with other channels, or independently of other channels, delayed or advanced with respect to other channels, depending on the state of the at least one kinematic disconnection/connection device for kinematically disconnecting/connecting at least one movable surface from the at least one kinematic connection apparatus.

Other aspects of the launcher are provided in the attached claims.

According to a further aspect, the invention relates to a packaging station for making at least one pack of paper products formed by one or more layers of products, comprising a launcher according to one or more of the attached claims, a subsequent module for receiving the launched products and a module for making the pack with a plurality of launched products.

According to another aspect, the invention relates to a converting line for converting plies of paper or non-woven fabric, wound in parent reels, into products made of paper or non-woven fabric, comprising a packaging station according to one or more of the attached claims.

BRIEF DESCRIPTION OF THE DRAWING

The invention shall be better understood by following the description and the accompanying drawing, which show non-limiting examples of embodiment of the invention. More particularly, in the drawing.

DETAILED DESCRIPTION OF EMBODIMENTS

With reference to the above listed figures, a converting line for paper rolls, for instance tissue paper rolls, according to the invention is indicated as a whole with number 10. The line can be formed by several branches that produce different paper products, or by a single branch that produces a single type of products.

For example, a branch 1A of the converting line 10 comprises, in succession, a converting apparatus T for converting paper plies, wound in large diameter parent reels, into paper rolls with diameter and length equal to those of a first final product (for example rolls R), and ends on a packaging station 30.

Figure 2:
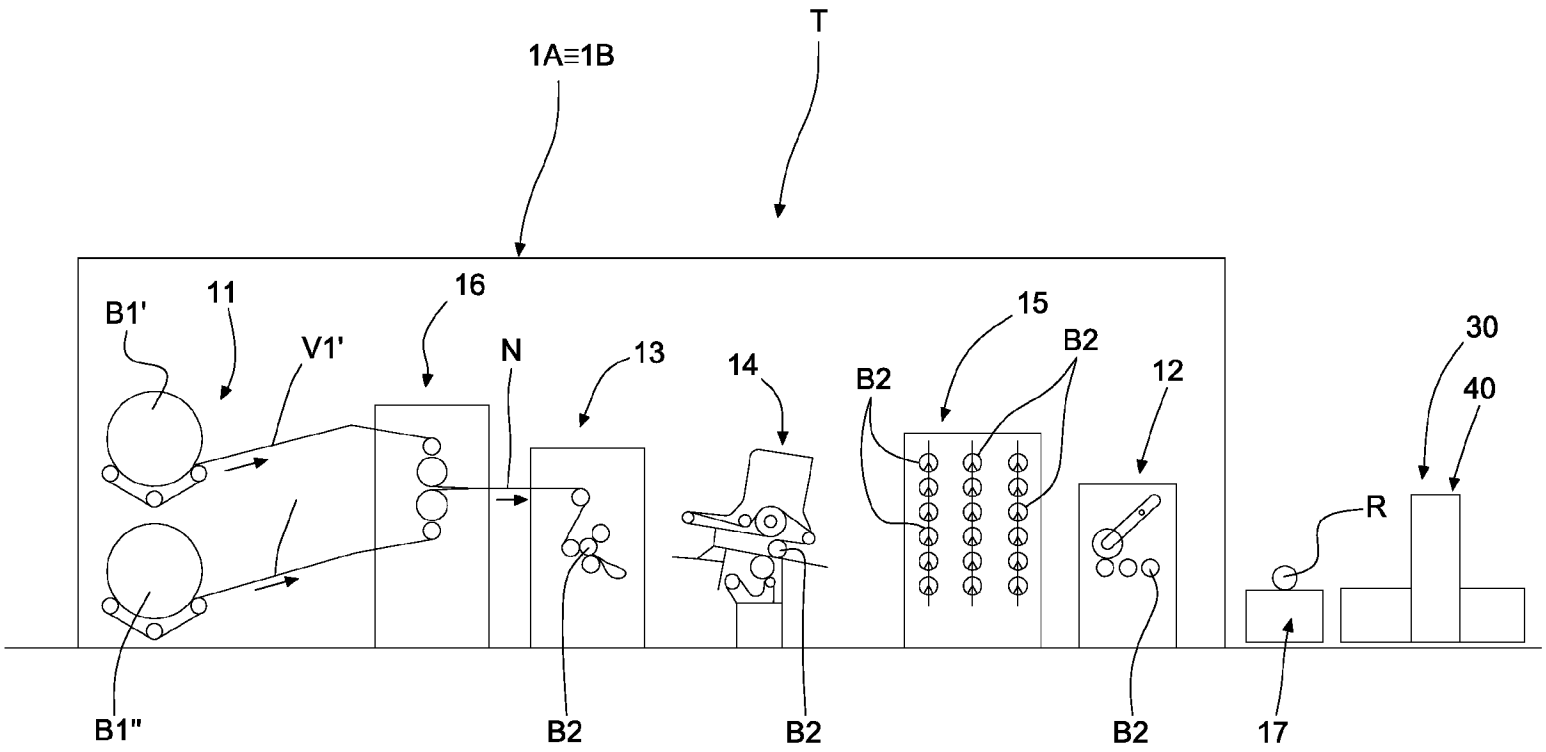
FIG. 2 is a schematic side view of a converting apparatus for converting cellulose plies into paper rolls, for a converting line as per FIG. 1.
Figure 3:
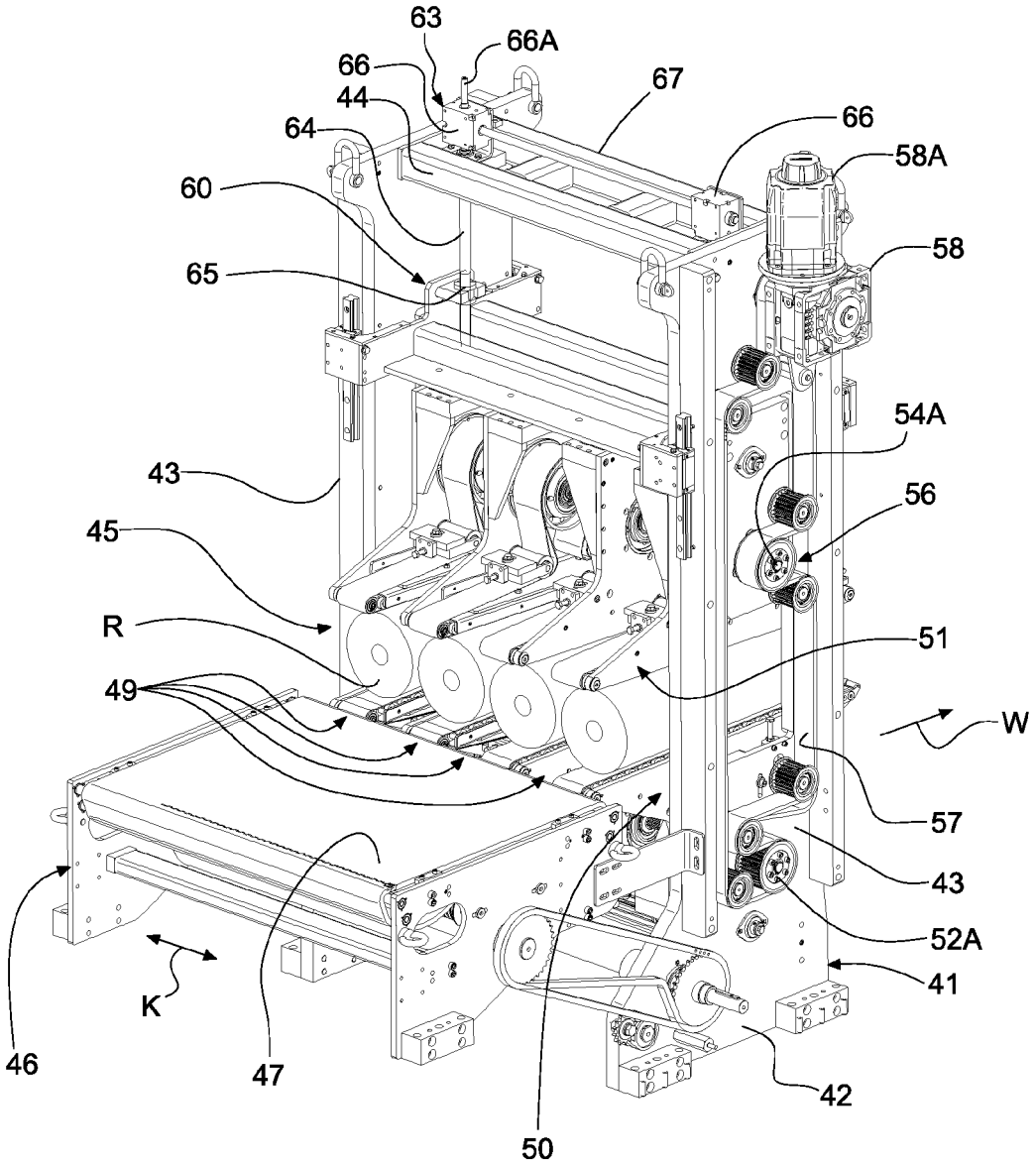
FIG. 3 is an axonometric view of the launcher according to the invention.
Figure 4:
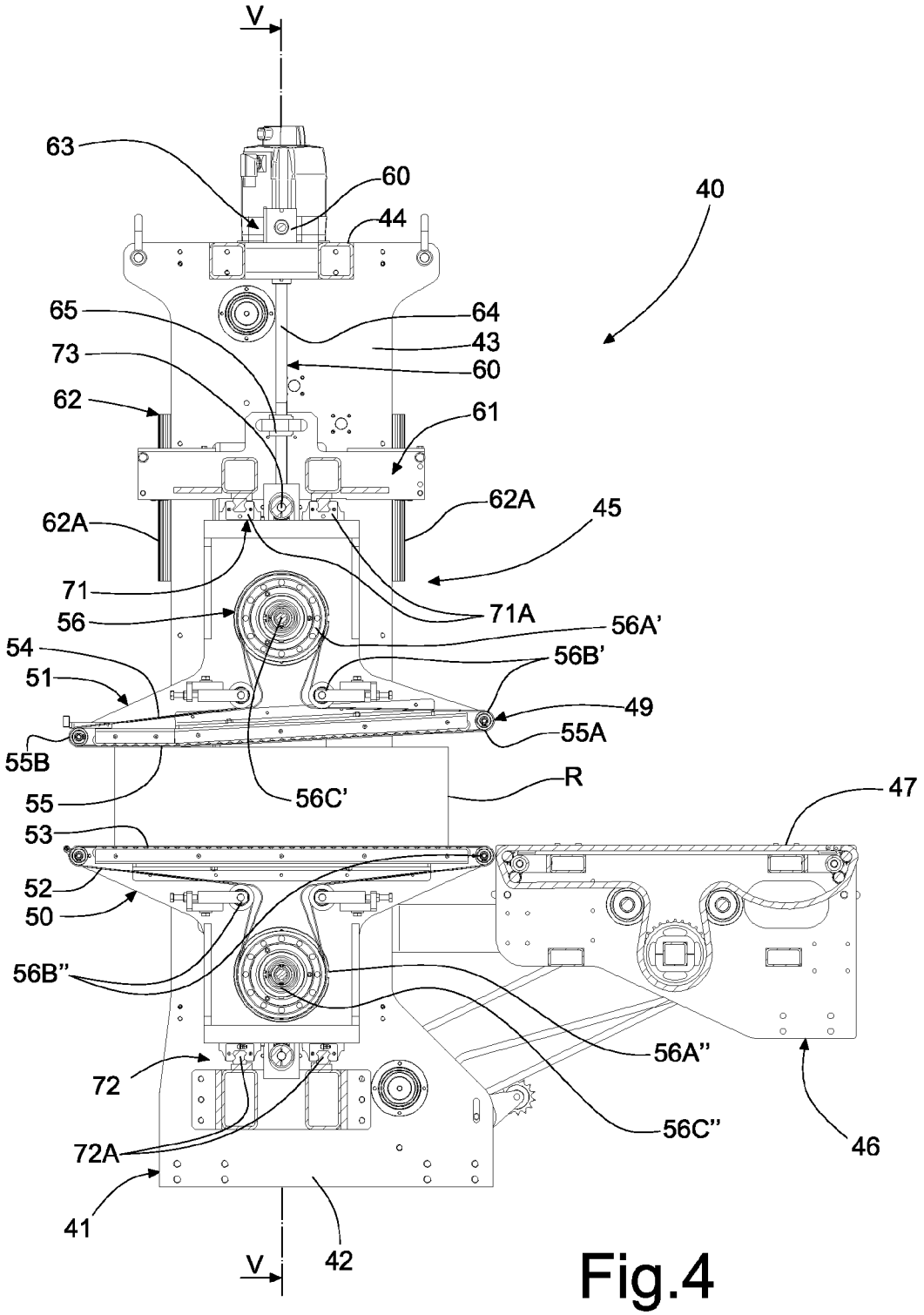
FIG. 4 is a side view of the launcher of FIG. 3 cut-away according to the plane IV-IV of FIG. 5.
Figure 5:
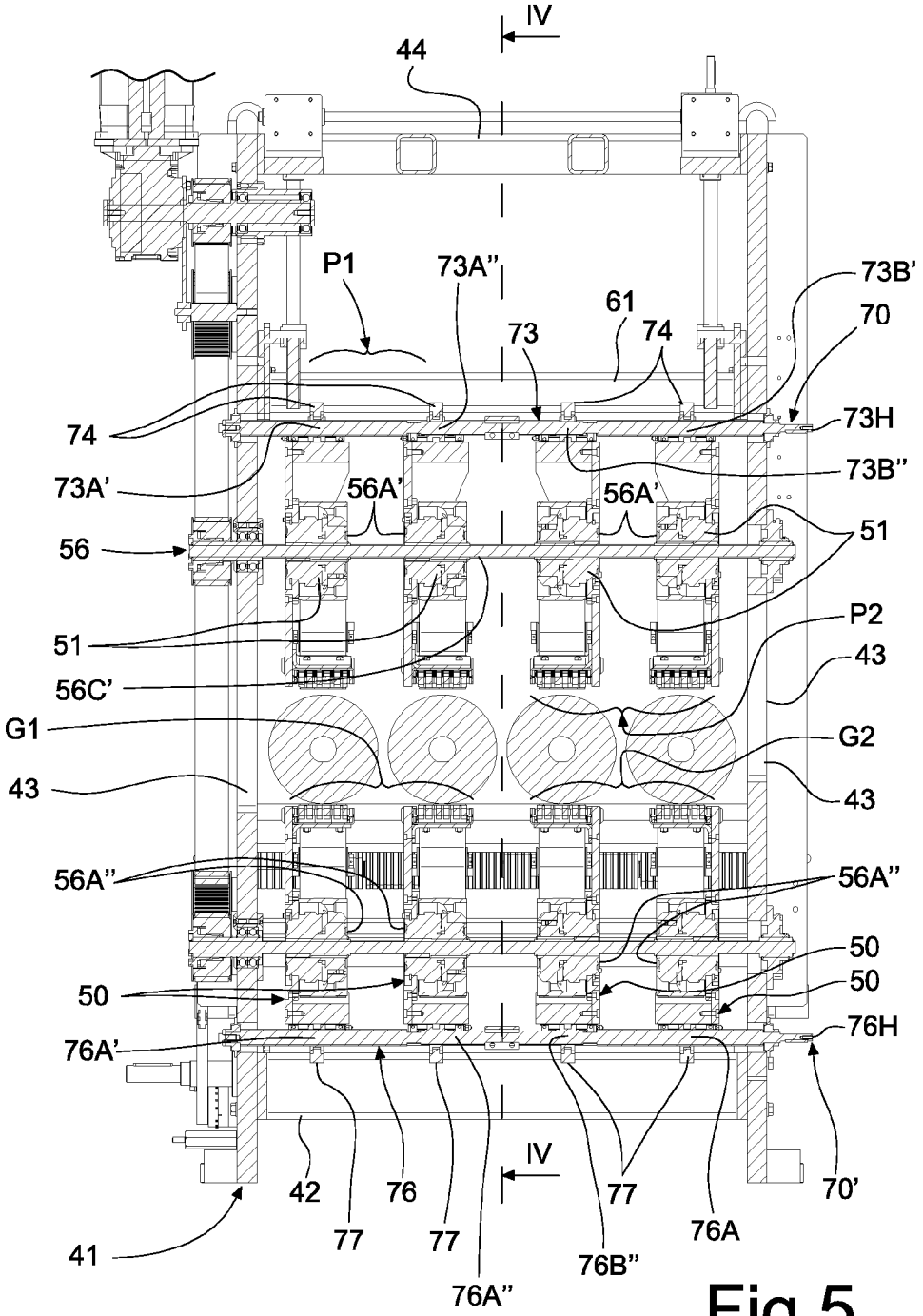
FIG. 5 is a front view of the launcher of FIG. 3 cut-away according to the plane V-V of FIG. 4.

The converting apparatus T for converting paper plies, wound in parent reels, into paper rolls can comprise a plurality of stations, units, groups or machines, some of which are schematically indicated in FIG. 2. In some embodiments, the apparatus T can comprise an unwinder 11, where one or more large diameter rolls, so-called master rolls or parent reels, B1' and B1" can be arranged, on which plies V1', V1" of web material, for example cellulose plies, such as tissue paper plies, are wound. Different types of unwinders are known to those skilled in the art, and can be configured in different ways. The details thereof will not be described herein. In the illustrated example, two parent reels B1' and B1" are provided, which supply two plies V1', V1", but it shall be understood that the number of parent reels being unwound and the number of plies supplied from the unwinder 11 can be different.

One or more processing stations for the plies V1', V1" can be arranged downstream of the unwinder 11. For example, a printing station or unit can be provided, for printing one or both the plies, individually or after having bonded them together. In some embodiments, in addition to, or as a replacement of, the printing station or unit, an embossing unit 16 can be provided. The plies V1' and V1" can be embossed and bonded, for example glued, in the embossing unit 16, so as to form a multi-ply web material N.

The web material N can be fed to a rewinder 13, for instance a continuous automatic peripheral rewinder, of a known type, where the web material is wound in secondary reels or logs B2, with or without a central winding core. Rewinders are also known to those skilled in the art, and they will not be described in detail herein.

The secondary reels B2 produced by the rewinder 13 have a final free edge, so-called tail, that shall be fixed to the outer cylindrical surface of the secondary reel B2, so as to prevent the secondary reel from opening during the subsequent processing. To this end, downstream of the rewinder 13, a machine 14 for sealing the free edge can be provided, which closes, by gluing, embossing, mechanical ply-bonding or in any other suitable manner, the final edge of each secondary reel B2.

In general, a temporary storage unit 15 can be provided downstream of the machine 14 for sealing the free edge, which divides the converting apparatus into two parts, which may have fluctuating production speeds, i.e. production speeds that vary over time differently in the two parts of the apparatus. The temporary storage unit 15 forms a reserve which allows the production speed of the rewinder to vary with respect to the production speed of the machines downstream of the temporary storage unit 15, including a severing machine 12, which subdivides the secondary reels B2 into single rolls R. Severing machines are also known to those skilled in the art, and they will not be described in detail herein.

The severing machine 12 also allows cutting the ends of the secondary reel B2, generally defined as "trimmings", which correspond to rolls with dimensions (in terms of axial length) smaller than the final rolls R. The trimmings are wastes that shall be removed from the flow of moving rolls.

The axis z of the rolls R exiting the severing machine is horizontal. The severing machine has preferably two or more cutting channels, where the secondary reels B2 are put and progressively moved forwards during cutting. To each channel of the severing machine 12 corresponds one transport belt, or a plurality of transport belts, 17 conveying the rolls R towards the packing machine 30. In some embodiments, a single transport belt 17 is provided, with the various channels separated by means of side banks, or a transport belt 17 for each channel, each separated by means of side banks.

On the contrary, a converting line for forming folded products such as wipes, facial tissues or paper towels, not specifically illustrated here, is provided with an interfolding machine instead of a rewinder 13. Therefore, the final products are not rolls, but distinct stacks of interfolded paper plies. In this case, the machine for closing the free edge is omitted, but a machine can be provided for wrapping the outer edges of the stack of interfolded sheets. Usually, paper sheets are used for wrapping. The accumulator 15 may be provided or not. A severing machine 12 is provided in this case again, for cutting the wrapped stacks into finished products to be packed. Alternatively, the products may be cut without being wrapped in paper, but inserted in cardboard boxes.

Figure 1:
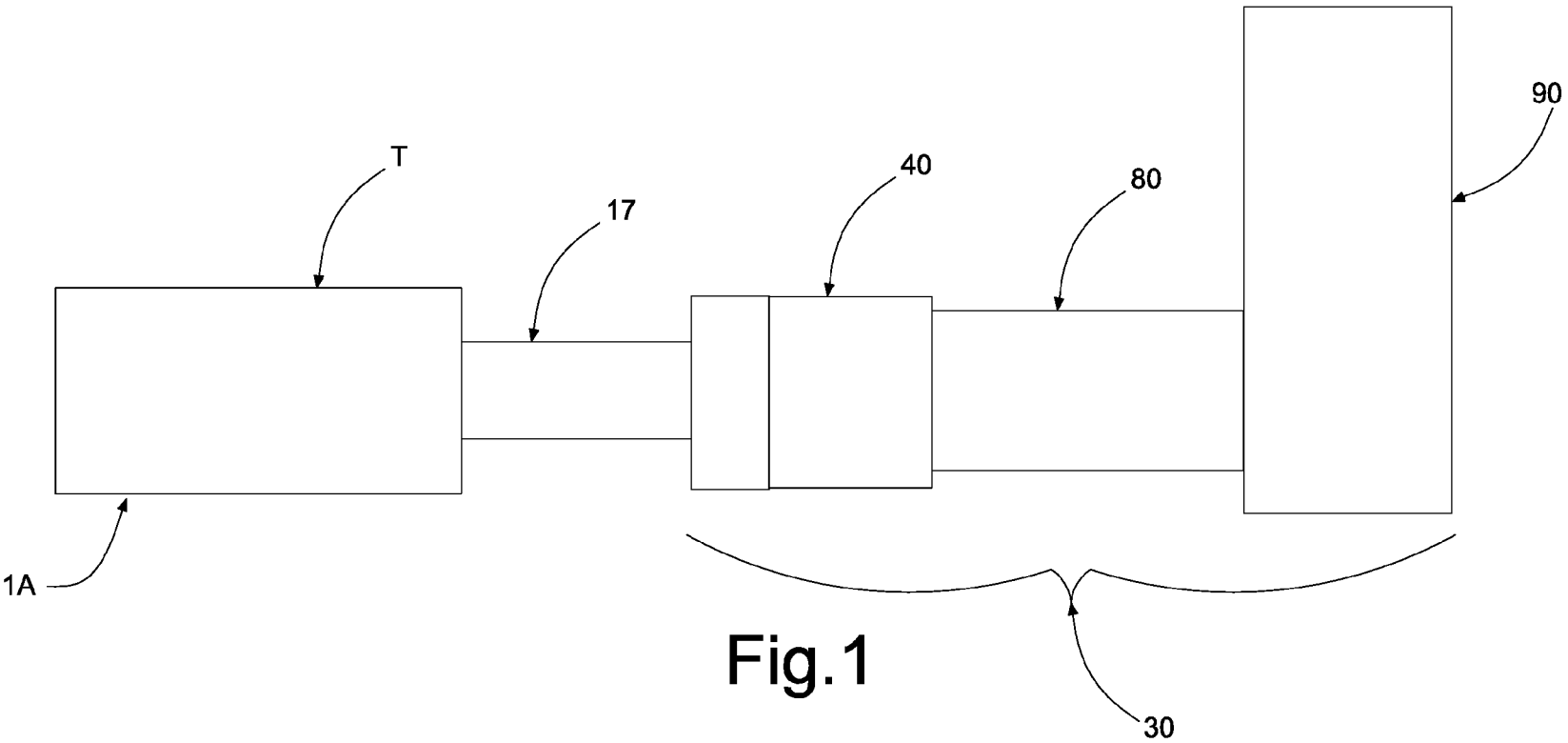
FIG. 1 is a schematic plan view of a converting line with a packaging station provided with a launcher according to the invention.

A further example of converting machine is constituted by the machines for producing napkins, not specifically illustrated herein. In this case, instead of an interfolding machine a folding machine is provided, which adequately folds the paper to form a folded continuous web that is then cut to form napkins with the classical folds ¼, ⅛, ⅙, known to those skilled in the art. Interfolding machines and folding machines for napkins are known to those skilled in the art and will not be described herein. The diagram of FIG. 1 is essentially valid for both the converting lines for forming folded products such as wipes or towels made of paper or non-woven fabric, and the converting lines for forming napkins, provided that the rolls R are considered as packs of paper sheets or possibly of non-woven sheets.

With reference to the disclosed example again, the rolls R are moved by the series of belts 17, keeping the axis thereof horizontally, towards the packaging station 30 (likewise the interfolded and folded products would be transported by belts 17 towards the packaging station 30).

The packaging station 30 has a product launcher 40, which allows the products coming from the branch 1A to be launched at with the desired frequency and order towards a module 80 for receiving the launched products and a module 90 for making the pack with a plurality of products launched in the receiving module, as better explained below.

The launcher 40 comprises a frame 41 formed by a base structure 42, two flanks 43 and an upper structure 44 in the form of a crossbar, between which an operating space 45 is defined, where the products arrive to be launched with the desired frequency and order (for example rolls R).

An inserting section 46 is provided, which extends in cantilevered manner from the frame 41 and on which a belt 47 is arranged, where the products to be launched arrive, possibly in groups aligned transversally to the launch direction W. The belt 47 moves the products in the launch direction towards the operating space 45. In a variant of the invention, the inserting section 46 does not extend in cantilevered manner from the frame 41, but forms part of a belt arranged upstream of the product launcher 40.

In the operating space 45, launch channels 49 are provided, each of which allows the launch of a respective product in the launch direction W (launch direction means a bundle of parallel directions, each of which is associated with a respective launch channel, i.e. the products exit the respective launch channels according to parallel directions).

In particular, in this embodiment, four launch channels 49 are provided. For the sake of simplicity, particular reference will be made below to a single launch channel 49, all the others being the same. For this reason it is easy to understand that even more than four channels, or fewer than four channels, can be provided.

Each launch channel 49 has a lower launching member 50 and an upper launching member 51. Each launching member comprises a motorized launch belt, closed in a loop, which defines a movable launching surface which touches a corresponding side of the product to be launched. In particular, the lower launching member 50 has a lower launch belt 52, which defines a lower movable surface 53, and the upper launching member 51 has an upper launch belt 54, which defines an upper movable surface 55. The movable surfaces 53 and 55, which are thus arranged below and above the space that can be occupied by the product in the respective channel, allow the product to be dragged in the launch direction.

The lower and upper launching members 50 and 51 are vertically aligned, i.e. they have substantially the same transverse position (that is, orthogonal to the launch direction W), so that the respective movable surfaces overlap vertically in a corresponding way, i.e. the respective plan views are superimposed on each other.

In this example, the segments of the launch belts 52, 54 that define the movable surfaces are in contact (on the side not facing the products to be launched) with a plurality of sliding rollers (not shown in the figures for the sake of simplicity) so as to form a contrast, or pressure surface, for the rolls to be launched.

The lower movable surface 53 is approximately at the same height as the belt 47, so as not to have obstacles to the introduction of the products from the belt, preferably arranged in an approximately horizontal direction.

More preferably, the two lower and upper movable surfaces 53 and 55 are at least partially converging in the launch direction W. For example, the part 55A of the upper movable surface 55 provided at the entrance of the launch channel 49 for the product R to be launched, and the part 55B of the same upper movable surface 55 provided at the exit of the launch channel for the product to be launched, are at different heights, with the entrance part 55A at a distance from the lower movable surface 53 greater than the distance of the exit part 55B. In particular, the upper launching member 51 is positioned so that the distance of the entrance part 55A from the lower movable surface 53 is greater than the height, in this example the diameter, of the product to be launched through that launch channel. Preferably, in order to exert on the rolls R a pressure sufficient to transfer the motion from the launching members to the products, the distance between the lower movable surface 53 and the exit part 55B of the upper movable surface 55 is lower than or equal to the diameter or height of the product to be launched.

Conveniently, the launcher 40 comprises adjusting means for adjusting the distance between the respective opposite lower and upper movable surfaces of the launch channels, so as to adjust the height of the space based on the height of products to be launched, as well as varying means for varying the position of the launch channels in the direction K transverse to the launch direction, in order to adjust the space based on the width and type of the products to be launched.

For example, an adjusting device 60 is associated with each launch module 48 for adjusting the distance between the respective opposite lower and upper movable surfaces of the launch channels.

For example, the adjusting device 60 comprises a carriage 61 slidable on the frame 41 from the top to the bottom and vice versa, preferably in vertical direction. In particular, the carriage 61 is arranged on a first guiding apparatus 62 provided on a flank 43 of the frame 41, for example formed by two first guides 62A. All the upper launching members 51 of the launcher are arranged on the carriage 61. As better explained below, the vertical distance between the upper launching members 51 and the lower launching members 50 can be adjusted by acting on a carriage moving system (the lower launching members 50, and therefore the respective movable surfaces, are arranged at a fixed height with respect to the frame).

As mentioned above, it is possible to vary the transverse position of the launching members. For example, a varying device 70 is provided for varying the position of the launch channels transversely to the launch direction, the device comprising for example a second guiding apparatus 71 provided on the respective carriage 61, which comprises for example a plurality of second guides 71A, to allow the transverse displacement of the upper launching members, and a further second guiding apparatus 72 provided on the frame, for example on the base 42, such as for example a plurality of further second guides 72A, to allow an equivalent displacement of the lower launching members. As explained below, means are present which allow the movement of the lower and upper launching members in equivalent and contemporaneous manner.

Downstream of the launcher 40, a subsequent receiving module 80 is provided for receiving the launched products and, downstream of the module 80, a packing module 90 for forming a pack.

As better explained below, all the launch channels are actuated by means of a common actuation system. It is however possible, if necessary, to exclude one or more launch channels, in order either to launch with a number of channels lower than the maximum number available, or to delay the launch of one (or more) channel(s) with respect to the other channels, for example by excluding and immediately including again the channel after a short period of time, according to needs, so that each launch channel can launch the respective product at a time different with respect to the launch of another launch channel, even more maximizing the production flexibility.

With reference again to the launcher 40, in this example the adjusting device 60 provides an actuation system 63 associated with the carriage 61 to allow the movement thereof along the first guides 62A provided on the flank 43. For example, the actuation system 63 comprises a first worm 64, which extends parallel to the first guides 62A and is coupled to a first nut 65 provided on the carriage 61. This first worm is operatively connected to a moving member (not shown in the figures for the sake of simplicity), for example a hand wheel for manual actuation or an electric motorization (or other type of motorization) for motorized actuation, or other. To a rotation of the output of the moving member (hand wheel or motorization) corresponds a rotation of the first worm 64 and therefore a vertical movement of the carriage 61, and therefore of the upper launching members 51 constrained thereto. In this example, the first worm 64 exits from a first transmission gear 66 from which a pin 66A comes out, which is in turn kinematically connected to the moving member (hand wheel or electric motorization). The actuation system 63 can be redundant on both flanks 43 and the ends of the carriage 61, thus two nuts 65 are provided at the ends of the carriage 61 and two first worms 64, coupled to the nuts and entering respective first transmission gears 66 are provided on the crossbar 44 and kinematically connected by a transmission rod 67, wherein the pin 66A is provided on only one of the first two transmission gears 66.

As regards the actuation system for varying the transverse position of the launching members, the varying device 70 provides for example a second worm 73 arranged on the carriage 61 parallel to the second guides 71A with a first portion thereof engaging second nuts 74 provided on a first group P1 of first upper launching member 51, and a subsequent second portion, having a thread directed opposite the first portion, which engages further second nuts 74 arranged on a second group P2 of second upper launching member 51 provided on the second guides 71A of the carriage 61. The second worm 73 is kinematically connected, for example by means of a connection pin 73H, to a manual or motorized actuation system (not shown in the figures) such as for example a hand wheel or an electric motorization.

More particularly, each first and second portion of worm 73 with thread in opposite direction is further subdivided into a first part and a second part, whereby the worm 73 is subdivided into a first part 73A' of the first portion and a second part 73A" of the first portion, and a first part 73B' of the second portion and a second part 73B" of the second portion (the latter two with thread opposite to the other two parts). In more detail, the second parts 73A" and 73B" (which are those furthest from the respective flanks 43), have a thread pitch double the respective first parts.

The position adjustment can take place, for example, starting with the upper launching members provided on the first portion of the worm arranged close to a flank 43 thereof and with the further upper launching members provided on the second portion of the worm arranged close to the opposite flank. A rotation of the second worm 73 brings the second nuts 74, and therefore the respective upper launching members 51 arranged slidably on the carriage 61, to translate in one direction or the other (with the innermost upper launching members moving to a double extent compared to the outermost launching members, as on a double pitch thread), depending on the direction of rotation of the worm.

Analogously, as regards the lower launching members arranged on the further second transverse guides 72A, the varying device 70' provides for example a further second worm 76 arranged on the carriage 41 parallel to the further second guides 72A with a first portion thereof engaging third nuts 77 provided on a first group G1 of first lower launching member 50, and a subsequent second portion, having a thread directed opposite the first portion, which engages further third nuts 77 arranged on a second group G2 of second lower launching member 50 provided on the further second guides 72A on the frame. The second worm 76 is kinematically connected, for example by means of a connection pin 76H, to a manual or motorized actuation system (not shown in the figures) such as for example a hand wheel or an electric motorization.

More particularly, each first and second portion of the further second worm 76 with thread in opposite direction is further subdivided into a first part and a second part, whereby the worm 76 is subdivided into a first part 76A' of the first portion and a second part 76A" of the first portion, and a first part 76B' of the second portion and a second part 76B" of the second portion (the latter two with thread opposite to the other two parts). In more detail, the second parts 76A" and 76B" (which are those furthest from the respective flanks 43), have a thread pitch double the respective first parts.

The position adjustment can take place, for example, starting with the lower launching members provided on the first portion of the worm arranged close to a flank 43 thereof and with the further lower launching members provided on the second portion of the worm arranged close to the opposite flank. A rotation of the further second worm 76 brings the further third nuts 77, and therefore the respective lower launching members 50, arranged slidably on the carriage, to translate in one direction or the other (with the innermost lower launching members moving to a double extent compared to the outermost launching members, as on a double pitch thread), depending on the direction of rotation of the worm.

It should be noted that in this example the varying device for varying the transverse position of the launch channels provides two distinct varying sub-devices 70 and 71 that can be operated independently of each other, so that the operator shall act in corresponding way on both sub-devices 70 and 71 to obtain the same displacement of the lower and upper launching members in order to have them in the same transverse position.

It is clear that, in other examples, the actuation of the two sub-devices can take place simultaneously; for example, if two equal electric motorizations associated with the two worm 73 and 76 are provided, it is sufficient to give a single command to both motorizations, for example simultaneously.

It is also possible, for example by means of respective transmission gears associated with the pins 73H and 76H and a transmission rod therebetween, kinematically to connect the two worms 73 and 76 and to act with a single moving member (a hand wheel or a motorization) to move simultaneously the two worms and therefore to move the lower and upper launching members in an equivalent and simultaneous way.

As regards the movable launch surfaces 53-55, the launch belts 52-54 of the lower and upper launching members are kinematically connected to one another by means of a kinematic connection apparatus 56, so that the movable surfaces of the various launch channels can be moved simultaneously or even non-simultaneously, as it will become more apparent below.

In particular, the kinematic connection apparatus 56 comprises, for each upper launching member 51, a transmission wheel 56A' which moves the respective launching belt 54 closed in a loop (guided between transmission and tensioning rollers 56B'). A transmission shaft 56C' is provided, connected to the transmission wheels 56A' of the upper launching members 51, whereby the rotation of the transmission shaft causes the simultaneous movement of the launch belts of the upper launching members. In this example, the connection between the transmission shaft and the transmission wheel is such as to allow the transmission of the rotation and, at the same time, the relative sliding of the transmission wheel on the shaft, to allow the variation of the transverse position of the wheel on the shaft, as better explained below.

Analogously, the kinematic connection apparatus 56 comprises, for each lower launching member 50, a transmission wheel 56A" which moves the respective launching belt 52 closed in a loop (guided between transmission and tensioning rollers 56B"). A transmission shaft 56C" is provided, coupled to the transmission wheels 56A" of the lower launching members 50, whereby the rotation of the transmission shaft causes the simultaneous movement of the launch belts of the lower launching members. In this example again, the connection between the transmission shaft and the transmission wheel is such as to allow the transmission of the rotation and, at the same time, the relative sliding of the transmission wheel on the shaft, to allow the variation of the transverse position of the wheel on the shaft, as better explained below.

Conveniently, in this example, the kinematic connection apparatus 56 comprises a first moving pulley 54A provided on the carriage 61 and coupled to the transmission shaft 56C' relating to the upper launching members 51 and, analogously, a second moving pulley 52A, coupled to the transmission shaft 56C" relating to the lower launching members 50 and provided on the frame 41. A transmission belt 57 is provided, which kinematically connects the first moving pulley 54A and the second moving pulley 52A to a common drive pulley 58 arranged on the frame 41 and coupled to a motorization 58A. Therefore, the activation of the motorization 58A drives the two transmission shafts 56C' and 56C" simultaneously in rotation, and therefore all the transmission wheels 56A' and 56A", and therefore all the launch belts of the launching members, i.e. activating all launch channels simultaneously.

To allow not to operate a launch channel together with the others, at least one kinematic disconnection/connection device is provided for kinematically disconnecting/connecting at least one launch channel from the kinematic connection apparatus, which acts by disconnecting the movable surfaces, i.e. the launch belts from the kinematic connection apparatus, for example by disconnecting them from the transmission shaft.

For example, a kinematic disconnection/connection device 85 is associated with each launching member, and more particularly with each transmission wheel 56A' and 56A", so that the wheel can be operated on command by the kinematic connection apparatus to be disconnected/reconnected, for example, from the transmission shaft 56C'-56C".

It is clear that in order to connect/disconnect an entire launch channel, the connection/disconnection device must be applied and act simultaneously on the two transmission wheels of the lower and upper launching members of the channel in question.

Figure 6:
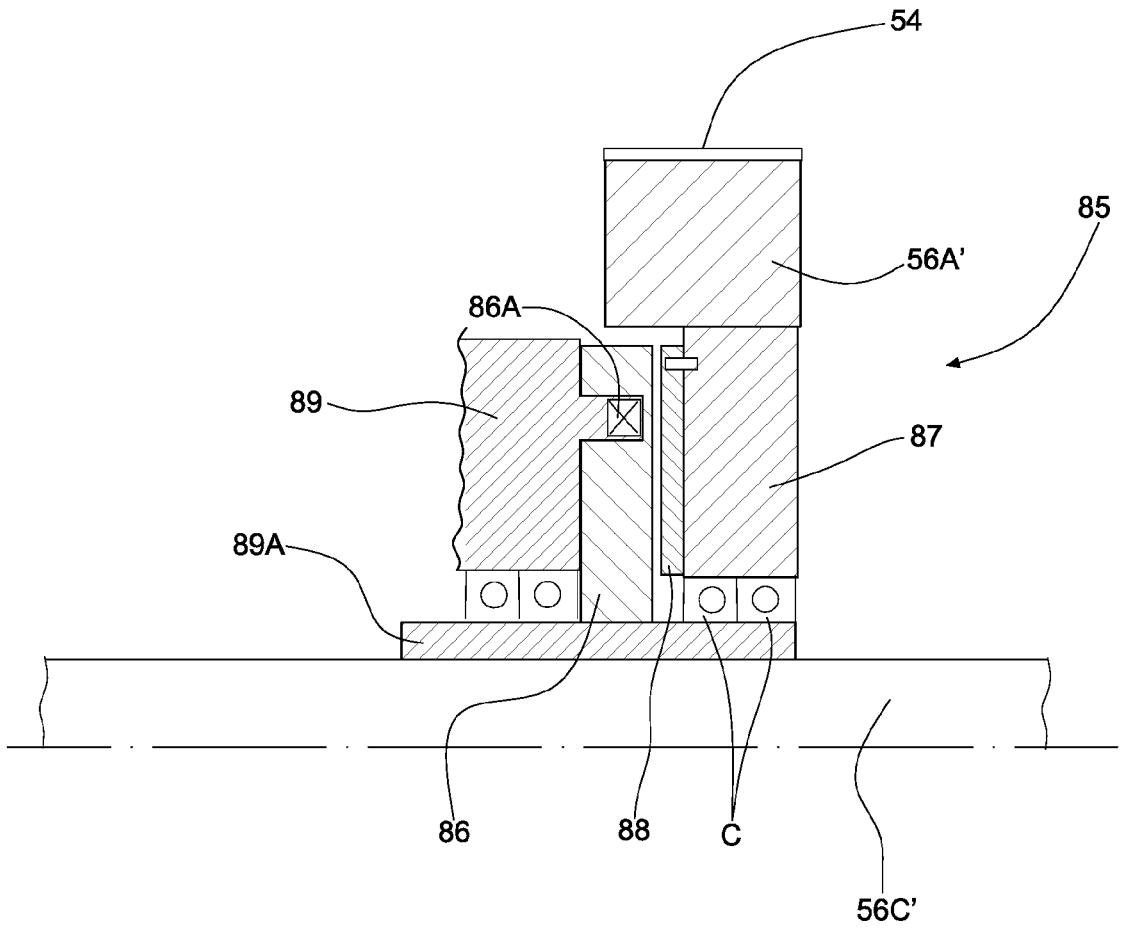
FIG. 6 is a schematic view of an axial section of the disconnection/connection device of a launching member for a launcher according to the invention.

FIG. 6 shows a diagram of a kinematic disconnection/connection device 85, associated for example with a transmission wheel 56A', but it shall be understood that the same device is applied to all the transmission wheels 56A'-56A" of the launcher.

The transmission wheel 56A' (56A") is arranged coaxially with its own transmission shaft 56C' (56C"), being able to rotate on it. For example, in a preferred embodiment the device 85 comprises a support 89A which is integral in rotation with the transmission shaft 56C and slides on it in axial direction. The device 85 also comprises a first portion 86 coaxially fixed to the support 89A, so as to rotate integrally with the device and with the shaft 56C'. Furthermore, the device 85 comprises a second portion 87 fixed to, or integrated with, the transmission wheel 56A', which is free to rotate around the transmission shaft (for example by means of bearings C), for example arranged rotating on the support 89A by means of bearings C. The device 85 further comprises a movable element 88 adapted to couple/release to/from the second portion 87 to operate the connection/disconnection and therefore to make the second portion 87 integral with the first portion 86 and to allow the integral rotation of the second portion 87 (and therefore of the transmission wheel 56A') around the transmission shaft 56C'.

For example, the kinematic disconnection/connection device 85 is of the electromagnetic type, and has electric coils 86A that are arranged for example on a third portion 89, fixed with respect to the body of the launching member, and face the periphery of the first part 86 close to the movable element 88. When current flows in the electric coils 86A, these coils are adapted to generate an attractive force on the movable element 88 in a connection/disconnection position or vice versa. For example, in this case, the movable element 88 is axially constrained to the second portion 87 and, when the current flows in the coils, the movable element is pushed against the first portion 86 (where, for example, brake pads, not shown in the figures, are provided) and the transmission wheel 56A' rotates together with the transmission shaft 56C', i.e. the respective launch belt is moved together with the other launch belts to which the transmission shaft is connected by the respective transmission wheels 56A'.

When no current flows in the coils, the movable element 88 is kept away from the first portion 86 by an elastic element (not shown in the figures) and therefore the transmission wheel 56A' does not rotate together with the transmission shaft 56C' and therefore the respective launch belt does not move, i.e. it is unable to launch products.

In practice, in this example, the kinematic disconnection/connection device 85 is a clutch. As an alternative to the clutches, it is possible to use a blocking system such as an electromechanical brake, which, once activated, connects the transmission wheel 56A' (56A") to the transmission shaft 56C' (56C"). In practice, by activating the brake, a movable element is clamped, i.e. blocked on the transmission shaft, thus obtaining the mechanical connection between transmission shaft and transmission wheel. By deactivating the brake, an elastic element returns the movable part of the brake, thus disconnecting the shaft from the wheel.

The kinematic disconnection/connection device 85 and the transmission wheel 56A' (56A") are arranged slidably on the transmission shaft 56C' (56C"), acting substantially in the direction of rotation; in this way it is possible to allow the variation of the transverse position of the launching members as described above.

As mentioned above, the packaging station 30 has a product launcher 40, which allows the products coming from the branch 1A to be launched with the desired frequency and order towards a module 80 for receiving the launched products and a pack making module 90 pack with a plurality of products launched in the receiving module.

For example, the set of products receiving module 80 and pack making module 90 can be provided in stations with wrapping machines as disclosed for example in EP3625131B1, EP1937557B1, EP276266B1, or, in general, the launcher 40 can be arranged in lines without modules 80 and be associated with wrapping machines such as those disclosed in these patent documents, whereby the products can be launched, i.e. dosed, in a cadenced manner based on the production speed, towards the wrapping machine.

In other examples, the set comprised of products receiving module 80 and pack making module 90 can be as disclosed in one or more embodiments of the patent application WO2021053571. For example, according to what disclosed there, the products receiving module 80 can be formed by one or more belts 81A, from which one or more anthropomorphic robots (not shown in the figures) collect the products launched by the launcher 40 in the belt 81A and insert them into boxes, that can be subsequently wrapped in a wrapping film in the module 90 or arranged on pallets; or the robots group the products into groups that are then processed in the module 90 to be wrapped in packaging film.

The fact that it is possible to connect/disconnect the transmission wheels 56A' (56A") of each single channel independently, allows independently to manage, with a single motor, each launch channel 49, i.e. to vary independently for each launch channel the time when each lower and upper movable surfaces 53 and 55 move to launch one or more products according to the format to be produced by the machines arranged immediately downstream. In other words, in addition to activating and deactivating individual channels in order to use an equal or smaller number of channels present, it is also possible to manage misalignments with respect to a reference launch point in order to balance any misalignment by executing launch algorithms according to what disclosed for example in EP2763917B1. All A the kinematic disconnection/connection devices 85 are in fact connected to a central control unit, which manages the connection/disconnection of each individual channel according to an operating logic, which not only depends on the pack to be made, which establishes how many channels to use and how many rolls to launch, but it is also linked to the correct management of the launch of each single roll.

It is understood that what is illustrated purely represents possible non-limiting embodiments of the invention, which may vary in forms and arrangements without departing from the scope of the concept on which the invention is based. Any reference numerals in the appended claims are provided for the sole purpose of facilitating the reading thereof in the light of the description above and the accompanying drawings and do not in any way limit the scope of protection.

The invention claimed is:

1. A launcher of paper products for packaging stations of paper product converting lines, comprising a frame where at least two launch channels are provided, on which the products to be launched are arranged, and wherein each launch channel of said at least two launch channels has opposite movable surfaces, at least one of said opposite movable surfaces is motorized, arranged in contact with opposite sides of a respective one of said products housed in the channel, to drag the respective one of said products in the launch direction, wherein two of said opposite movable surfaces are arranged below and above the space to provide an upper side and a lower side that can be occupied by the respective one of the products in the channel, so as to drag the respective one of the products by acting on the lower side and the upper side, and wherein at least an apparatus is provided for kinematically connecting the movable surfaces which are motorized, at least one kinematic disconnection/connection device being provided for kinematically disconnecting/connecting at least one of said movable surfaces from/to the at least one kinematic connection apparatus, that can be operated on command, wherein said at least one launch channel of said at least two launch channels is adapted to be connected or not connected to said kinematic connection apparatus based on whether said disconnection/connection device is adapted to act on the at least one launch channel for connecting/disconnecting, so that based on the disconnection/connection device:

said at least one launch channel is adapted to act together with at least a further launch channel connected to the kinematic connection apparatus, or said at least one launch channel is not adapted to act together with at least a further launch channel connected to the kinematic connection apparatus, so that in said launcher it is possible to have at a same time at least a launch channel adapted to launch when connected to the kinematic connection apparatus, and at least a launch channel adapted not to launch when disconnected from the kinematic connection apparatus.

2. The launcher according to claim 1, wherein said at least one launch channel comprises a lower launching member and an upper launching member, each of said lower launching member and said upper launching member is provided with a launch belt closed in a loop and defining a respective movable surface adapted to contact a respective side of the product to be launched.

3. The launcher according to claim 2, wherein each said launch belt is moved by a transmission wheel and wherein a kinematic connection apparatus is provided and adapted to connect each said transmission wheel of each said launch belt of the upper launching member, and/or a kinematic connection apparatus adapted to connect each said transmission wheel of each said launch belt of the lower launching member.

4. The launcher according to claim 3, wherein one of said at least one kinematic disconnection/connection device is associated with each said transmission wheel of each said launch belt, so that each said transmission wheel is operated on command to be disconnected/connected from/to the kinematic connection apparatus; wherein said one of said at least one kinematic disconnection/connection device acts simultaneously on said each said transmission wheel of the lower launching member and the upper launching member of a same channel, so as to disconnect/connect a whole launch channel from/to other launch channels.

5. The launcher according to claim 3, wherein the at least one kinematic disconnection/connection device is a clutch, adapted to connect/disconnect one said transmission wheel of a launch belt of a launching member to/from a transmission shaft associated with at least another one of said transmission wheel of a launch belt of another launching member.

6. The launcher according to claim 3, wherein said kinematic connection apparatus for each said transmission wheel comprises a common transmission shaft associated with each said transmission wheel, and wherein said at least one kinematic disconnection/connection device is adapted to disconnect/connect at least one said transmission wheel from/to the transmission shaft; said transmission wheel being arranged coaxially on said transmission shaft and said at least one kinematic disconnection/connection device comprises a first portion coaxially fixed to said transmission shaft, a second portion fixed to, or integrated with, said transmission wheel, and a movable element adapted to couple/release said second portion, fixed to, or integrated with, the transmission wheel to/from said first portion coaxially fixed to said transmission shaft to perform the connection/disconnection; said at least one kinematic disconnection/connection device is electromagnetic, and is provided with coils that, when current flows through the coils, are adapted to return said movable element to a position of connection/disconnection or vice versa.

7. The launcher according to claim 1, further comprising a device for adjusting distance between the opposite movable surfaces of said at least one launch channel.

8. The launcher according to claim 7, wherein said device for adjusting the distance between the opposite movable surfaces provides that the lower movable surface is fixed relative to said frame while the upper movable surface is movable to allow adjusting said distance thereof from said lower movable surface.

9. The launcher according to claim 7, wherein said device for adjusting the distance between the opposite movable surfaces comprises a carriage translatable from top to bottom and vice versa along a first guiding apparatus associated with the frame; an actuation system being provided and associated with the carriage to allow movement of the carriage along the guiding apparatus; said actuation system comprising a worm, associated with a manual or motorized actuator, that has a rotation axis arranged parallel to a guide of the carriage and engages a nut screw fastened to the carriage.

10. The launcher according to claim 9, wherein each said upper launching member is provided on the carriage.

11. The launcher according to claim 10, wherein a transmission shaft connected to transmission wheels of launch belts of each said upper launching member is provided with a first moving pulley provided on said carriage, the transmission shaft connected to the transmission wheels of the launch belts of each said upper launching member is provided with a second moving pulley provided on said frame, a transmission belt kinematically connects said first moving pulley and said second moving pulley to a common drive pulley provided on said frame.

12. The launcher according to claim 1, further comprising a device for varying a position of said at least one launch channel in a direction transverse to the launch direction.

13. The launcher according to claim 12, wherein said upper launching member and the lower launching member are arranged on guides transverse to the launch direction and forming part of said device for varying the position of the at least one launch channels.

14. The launcher according to claim 13, wherein at least one of said guides, on which respective one of the upper launching member slide, is arranged on said carriage, while another of said at least one guide, on which a respective one of the lower launching member slide, is fixed to the frame; a common moving member being provided and adapted to move said upper launching member and the lower launching member in a synchronous and equivalent manner; said common moving member comprising an upper worm, parallel to said guide provided on said carriage and engaging a nut screw associated with said upper launching member, and a lower worm, parallel to said guide, provided on said frame and engaging a nut screw associated with said lower launching member, a kinematic mechanism being provided for connecting said upper worm and said lower worm and operatively connected to a common manual or motorized rotation actuator.

15. The launcher according to claim 1, wherein each of said at least two launch channels are actuated by said kinematic connection apparatus, unless said at least one kinematic disconnection/connection device acts on the lower movable surface and the upper movable surface of a launch channel for disconnecting, so that this channel is not actuated by the kinematic connection apparatus.

16. The launcher according to claim 1, wherein one of said at least one launch channel of said at least two launch channels is adapted to be connected to said kinematic connection apparatus after a given time interval with respect to connection of at least one further launch channel, so that it is possible to have at least one channel adapted to launch in a moment not contemporaneous with a launch moment of another channel.

17. The launcher according to claim 1, further comprising a central control unit managing connection/disconnection of said at least one launch channel to/from the kinematic connection apparatus, and wherein said at least one kinematic disconnection/connection device is operatively connected to said central control unit; said central control unit being provided with an operating logic that provides for managing a number of launch channels to be used for launching of the products and managing a number of products to be launched based on type of pack to form, and calculates and/or controls any advances or delays in connecting/disconnecting a launch channel to/from said kinematic connection apparatus to correct misalignment with respect to a reference launch point and to balance errors in alignment of products/packs.

18. The launcher according to claim 1, further comprising at least two launch channels, each of which is formed by a lower launching member and an upper launching member, on which a respective motorized lower movable launch surface and upper movable launch surface are defined, a carriage being provided slidable on said frame from top to bottom and vice versa through a first guiding apparatus, on said carriage being provided a second guiding apparatus to allow transverse movement of each said upper launching member, on said frame being provided a further second guiding apparatus to allow transverse movement of said lower launching member, and wherein each of said at least one launch channel are actuated simultaneously by the kinematic connection apparatus unless said at least one kinematic disconnection/connection device acts on the lower movable surface and the upper movable surface of a launch channel for disconnecting so that the launch channel is not actuated by the kinematic connection apparatus.

19. A packaging station for making at least one pack of paper products formed by one or more layers of products with at least two types of products different from each other, comprising a launcher according to claim 1, a subsequent module for receiving the launched products and a module for making the pack with a plurality of launched products formed by at least two types of products different from each other.

20. A converting line for converting plies of paper or non-woven fabric wound in parent reels into products made of paper or non-woven fabric, comprising a packaging station according to claim 19; the converting line comprising two or more branches for converting different products made of tissue paper or non-woven fabric, that end in a common packaging station, so that in said station there can be present at the same time at least two types of products different from each other.

* * * * *